United States Patent [19]

Dillitzer

[11] 4,232,309

[45] Nov. 4, 1980

[54] ROLLER SHUTTER

[75] Inventor: Manfred Dillitzer, Grobenzell, Fed. Rep. of Germany

[73] Assignee: Perfecta Rolladen Karl & Co., Westendorf, Fed. Rep. of Germany

[21] Appl. No.: 959,144

[22] Filed: Nov. 9, 1978

[30] Foreign Application Priority Data

Nov. 16, 1977 [DE] Fed. Rep. of Germany ... 7735191[U]

[51] Int. Cl.[3] ..... G08B 13/08

[52] U.S. Cl. ..... 340/547; 109/21; 200/61.62

[58] Field of Search ..... 340/547; 200/61.62, 200/61.84, 61.93, 61.71, DIG. 12; 109/21, 49.5, 38, 73, 75

[56] References Cited

U.S. PATENT DOCUMENTS

| | | | |
|---|---|---|---|
| 1,462,781 | 7/1923 | Babiarz | 109/21 |
| 3,009,138 | 11/1961 | Lindsay | 109/38 |
| 3,710,369 | 11/1973 | Takahashi | 340/547 |
| 3,975,723 | 8/1976 | Bowling et al. | 340/547 |

*Primary Examiner*—Glen R. Swann, III

*Attorney, Agent, or Firm*—Darby & Darby

[57] ABSTRACT

An alarm actuating roller shutter of interconnected armor links is disposed for movement within a pair of opposed guide rails each of which has an outer cross sectional chamber partitioned off from a guide cross sectional chamber. The alarm is actuated by a magnetic switch consisting of a magnetic actuator portion on at least one of the armor links and a stationary switch portion within the outer cross sectional chamber. The actuator and stationary switch portion are arranged so that the actuator portion will actuate the stationary switch portion when the roller shutter is in the closed position.

6 Claims, 4 Drawing Figures

ROLLER SHUTTER

BACKGROUND OF THE INVENTION

The present invention relates to an alarm actuating roller shutter. In particular, the invention relates to a roller shutter in which the alarm is actuated by a magnetic switch.

The subsequent installation of roller shutters into preexisting window structures creates specific problems because the preexisting window structure precludes the possibility of building into the window structure protective devices such as special switches in the window sill. In subsequently installed roller shutters, the problem of accommodating the safety element such as a release switch for an alarm system in the frame of the roller shutter arises. Here difficulties are caused by the limited space available for the installation of such protective switches.

Various protective devices designed to actuate an alarm during an unauthorized lifting of a closed roller shutter are known. These devices generally are mechanical devices in which the switch consists of a contactor arranged laterally on the armor inside a guide rail cross section of a guide rail, and a stationary switch which is mechanically switched by the contactor in the closed position of the armor. Generally the stationary switch is not visible from the front installation side (side furthest from window) of the roller shutter.

Frequently, roller shutters provided with these conventional devices suffer a drawback in that improper functioning of the mechanically interlocking switches either leads to a complete failure of the desired protective action, or to blocking of the armor or of the winding roller with the roller shutter closed due to engagement of the switches. In addition, the mechanical release of these switches necessarily causes wear of the switching elements. This wear can result in failure of the switches themselves after a prolonged installation time and frequent use, particularly with the access of dust and dirt which can never be completely prevented. In winter the switches of these roller shutters may actually freeze and become inoperable.

Accordingly, it is an object of the present invention to provide a roller shutter in which the proper functioning of the protective switch is ensured even under the above mentioned unfavorable conditions.

It is a further object of the present invention to provide a roller shutter of simple design.

SUMMARY OF THE INVENTION

These and other objects are provided by a roller shutter wherein the switch is a magnetic switch which is actuated without mechanical contact and whose actuation is a permanent magnet and whose stationary switch portion is secured on the guide rail. Preferably, the stationary switch portion is located inside the hollow cross section of the outer cross sectional chamber so that the stationary switch portion is not only completely invisible and inaccessible from the outside, but is also optimally protected against weather influences.

An advantageous embodiment of the roller shutter according to the invention consists of arranging the actuator of each magnetic switch on the bottommost link of the armor. In certain cases, however, it is also advantageous to secure the actuator on the first link of the armor which is not visible from the outside when the armor is closed.

The present invention can more clearly be appreciated by reference to the accompanying drawings wherein:

DETAILED DESCRIPTION OF A PREFERRED EMBODIMENT

Figure 1:
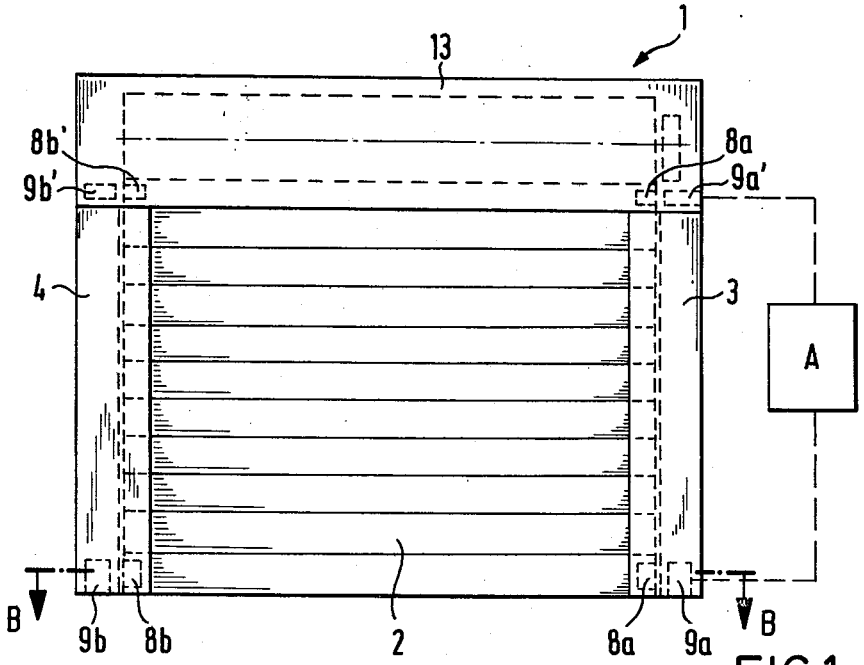
FIG. 1 is a front view of a roller shutter, according to the invention.

Referring to FIG. 1, reference character 1 generally designates a roller shutter. The roller shutter 1 has at its top a roller box 13 containing a winding roller for the roller shutter armor 2. The armor 2 has various individual links arranged in series and guided on armor chains, for example, in guide rails 3 and 4. In the position of the roller shutter shown in FIG. 1, armor 2 is let down completely, so that the roller shutter is closed. At both ends of the bottom link (furthest from roller box 13) of armor 2 are arranged permanent magnets 8*a* and 8*b*, which cooperate with contact-free release switches, 9*a*, 9*b*, arranged a small distance inside guide rails, 3, 4. The switches 9*a* and 9*b* are connected to an alarm system generally designated A, which can be actuated by them. Instead of the bottom arrangement (shown in FIG. 1) of the lateral switches 8*a*, 9*a*; 8*b*, and 9*b* or in addition to them, additional switches 8*a*', 9*a*'; 8*b*', and 9*b*' can be arranged so that they are at the level of the first link of the armor which is no longer visible from the front (installation) side of the roller shutter with the armor let completely down. These switches are also connected to the alarm system A by a line shown broken in FIG. 1. For purposes of clarity in FIG. 1, the connection to the alarm system A is only shown for the switches of one guide rail. The permanent magnet actuators 8*a*, 8*a*', 8*b* and 8*b*' which are arranged laterally on the links of armor 2 are commercial, permanent magnets. The contactors and the roller shutter armor move relative to the stationary switch parts 9*a*, 9*a*', 9*b*, 9*b*' which are arranged on the respective guide rails 3, 4.

Figure 2:
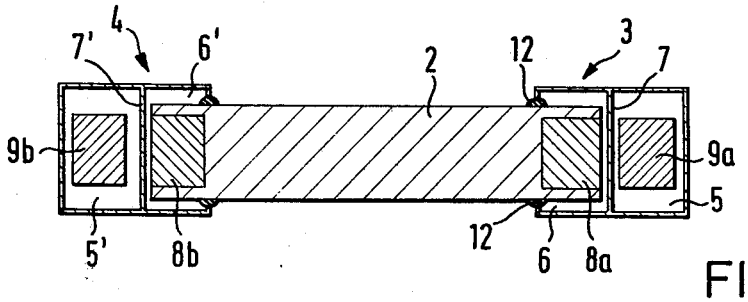
FIG. 2 is a horizontal cross-sectional view taken along the line B—B in FIG. 1.

The cross sectional view of FIG. 2 taken along line B—B of FIG. 1 shows a section through a link of armor 2. The permanent magnet actuators 8*a* and 8*b* are arranged at the lateral ends of the link of armor 2. This link of the roller shutter armor (as well as all others) protrudes laterally into the cross section of the guide rails which are open toward it. Both guide rails 3 and 4 have a total cross section which consists of two individual cross sectional segments. In each guide rail, 3, 4, there is a guide cross sectional chamber 6, 6', which is open toward the roller shutter armor. The individual links of roller shutter armor 2 protrude into the guide cross sectional chamber 6, 6'. Penetration of dirt between armor 2 and the guide cross sectional chamber 6, 6' is prevented by suitable sealing ledges 12 (shown only on one guide rail in FIG. 2) on the edges of the guide cross sectional chamber. The links of roller shutter armor 2 are guided during their movement by the guide cross sectional chamber. Separated by a partition 7, 7', the open guide cross sectional chamber 6, 6' is joined to a closed hollow cross section which forms an outer cross sectional chamber 5, 5'. In the outer cross sectional chambers are arranged stationary switch portions 9*a*, 9*b* which cooperate with the permanent magnet actuators 8*a*, 8*b* located at the lateral ends of the links of armor. By lowering the roller shutter, these stationary switch portions which are connected to an alarm system (shown in FIG. 1) are actuated by the magnetic field produced by the actuators 8*a*, 8*b*, so that alarm system A is turned off. In the case of an unauthorized opening of the roller shutter by lifting from the outside, actuators 8*a*, 8*b* are removed from the range of the stationary switch parts 9*a*, 9*b*, so that the desired switching pulse is generated and the alarm system is released. Partitions 7, 7' inside the sections of guide rails 3, 4 prevent the roller shutter armor 2 from yielding laterally. The partitions 7, 7' also seal the respective stationary switch portions 9*a*, 9*b* from undesired interferences such as dust or water which may enter through the opening in the guide cross sectional chamber.

In an alternative embodiment of the present invention, the stationary switch portion of each magnetic switch is secured on the rear installation side of a single chambered guide rail. This arrangement provides a particularly simple means for fastening the stationary switch portion onto the guide rail 3, 4. In addition, the stationary switch portion may be accessible from the window side, particularly in those cases where a new roller shutter is installed so that there is sufficient space available between the guide rail and the window arranged behind it.

In this alternative embodiment, it is advisable to arrange at least one magnetic switch at both sides of the armor so that the reliability of the safety device is further ensured.

Figure 3:
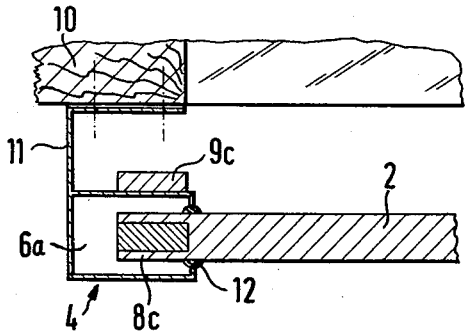
FIG. 3 is a horizontal cross-sectional view of an alternative arrangement for the magnetic switch of the roller shutter.

The alternative embodiment, is more clearly understood by reference to FIG. 3 wherein a roller shutter is secured on the wooden frame 10 of a window (fastening shown only schematically) by a distance rail 11, as is frequently the case in subsequent installations of mini roller shutters in new buildings. Between the back of guide rail 4 and the front end of wooden frame 10, and attached window pane there is a sufficiently large gap so that the stationary switch 9*c* may be fastened onto the back of guide cross sectional chamber 6*a* of guide rail 4. This manner of fastening is particularly simple and provides ready access from the window side. The permanent magnet actuators, 8*c*, should be arranged laterally on the individual links of armor 2 by inserting them from the rear or installation side of armor 2 and securing them at the lateral ends of the armor 2.

It will be apparent to those skilled in the art that the present invention may take a variety of forms, and that the foregoing description is illustrative only and that the scope of protection afforded this invention be determined by the appended claims.

Figure 4:
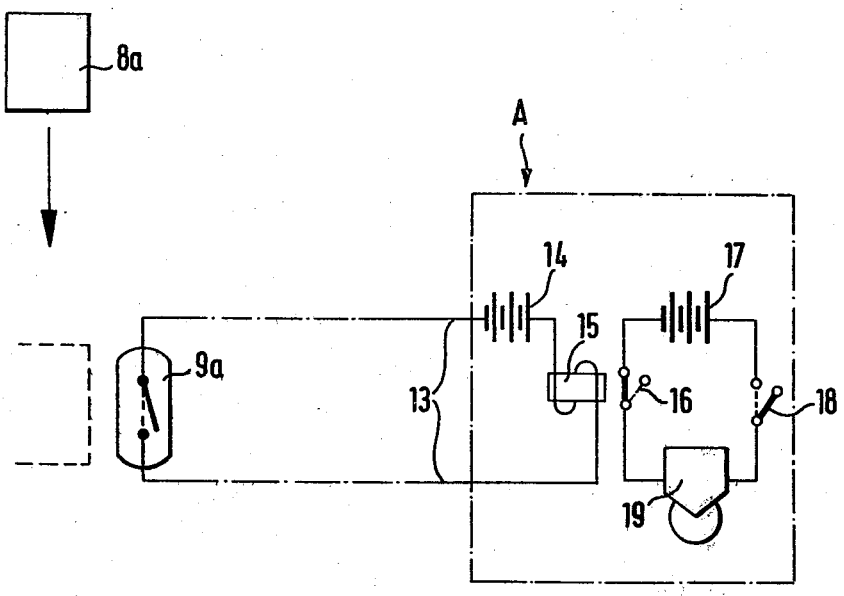
FIG. 4 is a schematic diagram of the electrical circuit.

FIG. 4 is the circuit diagram of a release switch and alarm circuit, according to the invention.

In the diagram of FIG. 4, reference numeral 8*a* shows a permanent magnet 8*a* which is incorporated in the end of a link of a roller shutter armor (not shown). The illustration in full lines shows the position just before closing the roller shutter armor, the arrow shows the direction of the motion of said magnet 8*a*, and the contour in broken line shows the position of said magnet 8*a* when the roller shutter armor is totally closed. In said latter position, the magnet 8*a* lies adjacent to a stationary, normally open reed switch 9*a*, which switch is open (full lines) as long as the roller shutter armor is not totally closed. If the roller shutter armor, in the contrary, is totally closed, the flux of the magnet 8*a* causes the reed switch 9*a* to be closed (shown in broken lines).

The reed switch 9*a* is connected to the alarm system A by means of electric wires 13.

In the alarm system A, a first electric power source 14, e.g. a dry battery, and a relay 15 are connected in line with the wiring 13 and the reed switch 9*a* and form a first circuit. The relay 14 triggers a normally closed contact 16 which is connected in line to a second electric power source 17, a main switch 18 and an alarm device 19, e.g. an alarm bell, forming a second circuit.

If the roller shutter armor is open, as shown, the reed switch 9*a* is open, the first circuit is interrupted, the contacts 16 are closed, and only the open main switch 18 prevents the bell 19 from being activated.

Closing of the roller shutter armor causes the first circuit to be closed, so the contacts 16 are reverted and opened (shown in broken lines), thus opening the second circuit. After closing the main switch 18 (shown in broken lines), the alarm system A is set. Now, removing the magnet 8*a*, that means any positive motion of the roller shutter armor, as well as interrupting the lines 13, — causes the bell 19 to be activated and thus the alarm to be released.

What is claimed is:

1. An alarm actuated roller shutter comprising:

a pair of opposed guide rails having a guide cross sectional chamber;

a roller shutter having a plurality of interconnected armor links disposed for movement along said guide rails, said links protruding into the guide cross sectional chambers at the lateral ends of said links;

at least one magnetic switch for actuating an alarm system, said magnetic switch comprising a first means having contacts which are actuated in response to a magnetic field and a second means for producing the magnetic field, one of said first and second means located on one of the lowermost of said links on the inner side of said roller shutter and the other of said first and second means fixedly mounted adjacent the guide cross sectional chamber of at least one of said guide rails, said first means being actuated by said second means in the fully closed position of said roller shutter, said one means being accessible when the roller shutter is raised by a substantial distance.

2. The roller shutter according to claim 1, wherein at least one of said guide rails further comprises an outer cross sectional chamber, said other means being located within the outer cross sectional chamber.

3. The roller shutter according to claim 1, wherein said other means of said magnetic switch is secured on the rear installation side of the guide cross sectional chamber of the guide rail.

4. The roller shutter according to claim 1, wherein at least one magnetic switch is arranged on the armor at each side of said roller shutter.

5. The roller shutter according to claim 1, wherein said one means of said magnetic switch is arranged on the bottommost link of the roller shutter.

6. The roller shutter of claim 1 further comprising a sealing ledge mounted on said guide rails so as to prevent entry of undesirable substances into the guide cross sectional chamber of said guide rail.

* * * * *